US006472648B2

(12) United States Patent
Matsuo et al.

(10) Patent No.: US 6,472,648 B2
(45) Date of Patent: Oct. 29, 2002

(54) MICROWAVE IRRADIATION CONTINUOUS FLOW HEATING APPARATUS

(75) Inventors: Masakazu Matsuo, 900 Aramoto, Higashi Osaka-shi, Osaka (JP); Hideaki Matsuo, 6-15-109, Sekimachi Minami 4-chome, Nerima-ku, Tokyo (JP)

(73) Assignees: Masakazu Matsuo, Osaka (JP); Hideaki Matsuo, Tokyo (JP); Kouichi Taneda, Kanagawa-ken (JP)

( * ) Notice: Subject to any disclaimer, the term of this patent is extended or adjusted under 35 U.S.C. 154(b) by 0 days.

(21) Appl. No.: 09/915,357

(22) Filed: Jul. 27, 2001

(65) Prior Publication Data

US 2002/0011487 A1 Jan. 31, 2002

(30) Foreign Application Priority Data

Jul. 28, 2000 (JP) ..... 2000-229860

(51) Int. Cl.[7] ..... H05B 6/80; H05B 6/72

(52) U.S. Cl. ..... 219/688; 219/693; 219/748; 219/756

(58) Field of Search ..... 219/687, 688, 219/689, 701, 746, 748, 756, 693

(56) References Cited

U.S. PATENT DOCUMENTS

| | | | | | |
|---|---|---|---|---|---|
| 3,812,315 A | * | 5/1974 | Martin | ..... | 219/688 |
| 4,178,494 A | * | 12/1979 | Bottalico et al. | ..... | 219/688 |
| 4,694,133 A | * | 9/1987 | Le Viet | ..... | 219/687 |

FOREIGN PATENT DOCUMENTS

| | | | | | |
|---|---|---|---|---|---|
| DE | 31 43 808 | * | 5/1983 | ..... | 219/688 |
| DE | 36 43 588 | * | 7/1987 | ..... | 219/688 |
| DE | 36 39 717 | * | 6/1988 | ..... | 219/688 |
| JP | 63-065251 | | 3/1988 | | |
| JP | 63-052296 | | 4/1988 | | |
| JP | 63-194251 | | 12/1988 | | |
| JP | 01-102242 | | 4/1989 | | |
| JP | 1-120249 | * | 5/1989 | ..... | 219/687 |
| JP | 01-088345 | | 6/1989 | | |
| JP | 05-248700 | | 9/1993 | | |
| JP | 05-288403 | | 11/1993 | | |

* cited by examiner

*Primary Examiner*—Philip H. Leung
(74) *Attorney, Agent, or Firm*—McDermott, Will & Emery

(57) ABSTRACT

A continuous flow type heating apparatus using microwave, which can continuously supply hot water with practically usable flow amount and temperature. An open part is formed on a top face of a horizontally prolonged empty box 10 to become an emitting port of the microwave. The empty box 10 is divided into two by a vertical partition except for the upper and lower part of the emitting port. One side of the space is horizontally divided into three by two of an upper and a lower partitions 12, 13 on which slits 12*a*, 13*a* are set at a desired interval. The space formed on the partition 12 becomes a first irradiation part 4. The space formed under the partition 13 and connected in lower part to the space on another side becomes a second irradiation part 5. A water supply pipe 2 is disposed at the center of the space formed between the partitions 12 and 13. The microwave from a microwave oscillator 6 is irradiated from the emitting port into the empty box 10. The microwave is irradiated from the slits 12*a*, 13*a* of the irradiation part 12, 13 to the upper and the lower part of the water supply pipe, respectively.

11 Claims, 4 Drawing Sheets

MICROWAVE IRRADIATION CONTINUOUS FLOW HEATING APPARATUS

BACKGROUND OF THE INVENTION

The present invention relates to a continuous flow type heating apparatus which can instantly heat up liquid continuously flowing in a pipe, and more particularly, a continuous flow type heating apparatus which instantly heats up fluid using microwave.

Among the methods to supply and heat up water continuously flowing in a pipe to a desired temperature like an instantaneous boiler, there are methods using gas or electricity as a heat source.

The gas using method employs a gas burner at the bottom of a housing, a heat exchange pipe in which water flows is configured such that the path of the pipe in the housing becomes relatively long, for example, in a spiral shape. Heating is carried out by heating the pipe from outside with the gas burner.

However, since it takes long to get the water inside hot by heating the pipe, the method is not always good in terms of heat efficiency. Since the method involves a combustion process, air is polluted. There is some fear of monoxide poisoning created by the combustion and of gas poisoning created by a black out of fire. Further, since the method requires a long pipe path in order to achieve high heating temperature, an apparatus itself is difficult to be designed small.

On the other hand, although the electrical method does not generate the problems of the air pollution, the gas poisoning, and a need for air exchange, involved in the gas method, the heater to heat up flowing water takes long for a temperature rise, requires a high running cost, and has a technological difficulty in supplying water at a constant temperature because the temperature of hot water decreases when the hot water being used.

Concerning the problems in the gas and the electricity, an induction heating method which instantaneously heats up fluid using magnetron, in the continuous flow type heating apparatus like the instantaneous boiler, is proposed.

For example, according to Japanese Utility Model Application Publication (KOKAI) S63-52296, there is disclosed a continuous liquid heating apparatus in which: a heating part made by installing one or multi-numbers of heating pipes in parallel, is located in a microwave irradiation chamber related to the microwave generator; the pipe is made of a metal pipe covered by exterior parts in which ferrite is mixed; in the heating part, a liquid-flow-in pipe and liquid-flow-out pipe are connected; the liquid is continuously heated from inside using microwave; and the ferrite having high microwave absorption efficiency is utilized to continuously heat up from outside during the heating.

In Japanese Utility Model Application Publication (KOKAI) S63-194251, is disclosed a water heater which comprises a chamber surrounded by walls of insulating material which cuts microwave, a radiation part which radiates microwave into the chamber, and water supply path configured such that the path goes through a microwave irradiation region in the chamber and can continuously supply hot water of necessary amount.

Further, in Japanese Utility Model Application Publication (KOKAI) H01-88345, is disclosed an instantaneous boiler comprising a microwave generator, partition which forms a second chamber containing fluid introduced from outside, a pipe which goes through the partition and a first chamber of the boiler, and is formed such that the fluid flowing inside is heated by the microwave oscillated towards inside of the boiler from the microwave generator.

On the other hand, in Japanese Patent Application Publication (KOKAI) S63-65251, is disclosed a liquid heating method which employs a microwave generator equipped with a microwave oscillating part in a shield case, and a pipe made of fluoric resin set in the shield case facing to said microwave oscillating part to efficiently heat up fluid flowing in the pipe by the microwave. Especially in the publication, it is described that the microwave generator comprises a power supply circuit supplied with commercial AC100V and oscillates microwave at 2450 MHz by receiving high voltage from a high voltage generator circuit generating a high voltage above several KV based on the voltage from the power supply.

In Japanese Patent Application Publication (KOKAI) H01-102242, is disclosed a water heater which can continuously supply hot water of a necessary amount by having a heating element made of microwave resistant material around the outer surface of a water path irradiated by a microwave.

In Japanese Patent Application Publication (KOKAI) H05-248700, is disclosed a boiler which controls a water temperature by changing the output of a microwave oscillator and the water flow when the microwave oscillated from a microwave oscillator is irradiated to the water in a pipe, a container and a bath in order to boil the water.

Furthermore, in Japanese Patent Application Publication (KOKAI) H05-288403, is proposed an electrical water heater comprising a water in gate and a water-out gate having a microwave absorber in mesh shape in a microwave applicator to irradiate microwave to the water flowing in the microwave absorber,.

Any of the electrical water heater and the instantaneous boiler described in said each publication has a common technological idea that microwave is irradiated to the liquid temporarily stored or the fluid continuously flowing, especially water, in order to heat and boil the fluid by the friction heat between water molecules. However, according to the research carried out by the inventors of the present invention, there has not been a fact that any instantaneous boilers using microwave for domestic use, have been sold or employed.

After a dedicated study of the continuous flow type heating apparatus using microwave described in the publications, the inventors of the present invention have reached to a conclusion that the instantaneous boiler and water heater have not come to practical use because even the irradiation of the microwave could not have achieved the sufficiently hot water.

That is, the diameter of the pipe set in the apparatus needs to be large in order to supply necessary amount of hot water in practical use, but sufficient heating can not be done because the pipe of larger diameter has a larger amount of the fluid flowing in the pipe and flow rate.

Higher heating temperature requires larger microwave irradiator with higher heating capability but there are many problems to solve that a larger apparatus occupies installation space, and the voltage of general domestic power supply (A.C.100V) can not be used, and a noise problem on operation is concerned, and leakages of microwave (electric wave leakage) is likely to occur, and the running cost largely increases.

SUMMARY OF THE INVENTION

Concerning such problems to solve, the inventors of the present invention have discovered as a result of further study that the microwave irradiated to water osmoses into the water, is absorbed and converted to heat, and then attenuates. As the microwave goes inward of water, it attenuates more to have insignificant contribution to water heating.

That is, the inventors have found that the power half reduction depth of the depth down to which the microwave can heat water, in other words, the depth where the microwave power density becomes ½ is about 10 mm, and in the case of flowing water, the power half reduction depth decreases down to ⅓. Based on this result, the present invention has been established.

The objective of the present invention seeks to provide a continuous flow type heating apparatus which heats up water flowing in a pipe by microwave and can continuously supply hot water of the amount and the temperature practically usable.

Another objective of the present invention is to provide a continuous flow type heating apparatus which can raise water temperature effectively with the length of the pipe in which fluid flows as short as possible.

Further objective of the present invention is to provide a continuous flow type heating apparatus which can reduce the consumed power by pre-heating the temperature of the flowing water by the effective use of the heat generated by the microwave oscillator which irradiates microwave.

Further objective of the present invention is to provide a continuous flow-type heating apparatus which employs a microwave generator of a water-cooling type and is completely sealed as a whole and therefore has no noise generation, does not require a particular installation location, prevents the dust from coming in the interior of the apparatus, has no adhesion of the dust to the interior of the condenser, transformer, and magnetron, and prevents the electric leakage caused by the dust.

To achieve the objectives, an invention described in claim 1 is directed to a continuous flow type heating apparatus which is characterized in that microwave irradiation parts are located at the positions facing to each other with a water supply pipe as a center in-between, fluid flowing in the water supply pipe is heated by half portions in the irradiation of microwave from an irradiation part.

An invention described in claim 2 is directed to a continuous flow type heating apparatus which is characterized in that:

a pair of microwave irradiation parts for which slits are formed at a desired interval along longer axis, are set facing to each other; and a water supply pipe is set at a central part between the irradiation parts; and a fluid flowing in the water supply pipe is heated by half portions with the irradiation of microwave from the slit.

Further, an invention described in claim 3 is directed to a continuous flow type heating apparatus which is characterized in that:

an opened part with a desired width is formed on an upper surface on one side of a horizontally prolonged empty box made of metallic material, to become a microwave emitting port;

the empty box is divided into two with a vertical partition except for an upper and lower part of the emitting port;

resultant one sectioned space is horizontally divided into three with two of upper and lower partition to which slits are set at a desired interval, orthogonal to the longer axis;

a space formed on the upper partition is a first irradiation part;

a space formed under the lower partition and connected to a space on another side, is a second irradiation part;

a water supply pipe is set at a central part of a space formed between said two of the upper and lower partitions; microwave from a microwave oscillator set on the empty box is emitted into the empty box from the emitting port; and microwave emitted from the slits of said each irradiation part, is irradiated to the upper and lower part of the water supply pipe.

DETAILED DESCRIPTION OF THE PREFERRED EMBODIMENT

Preferred examples of the continuous flow type heating apparatus of the present invention are explained below in conjunction with attached figures although its structure is not limited to those shown in the figures.

Figure 1:
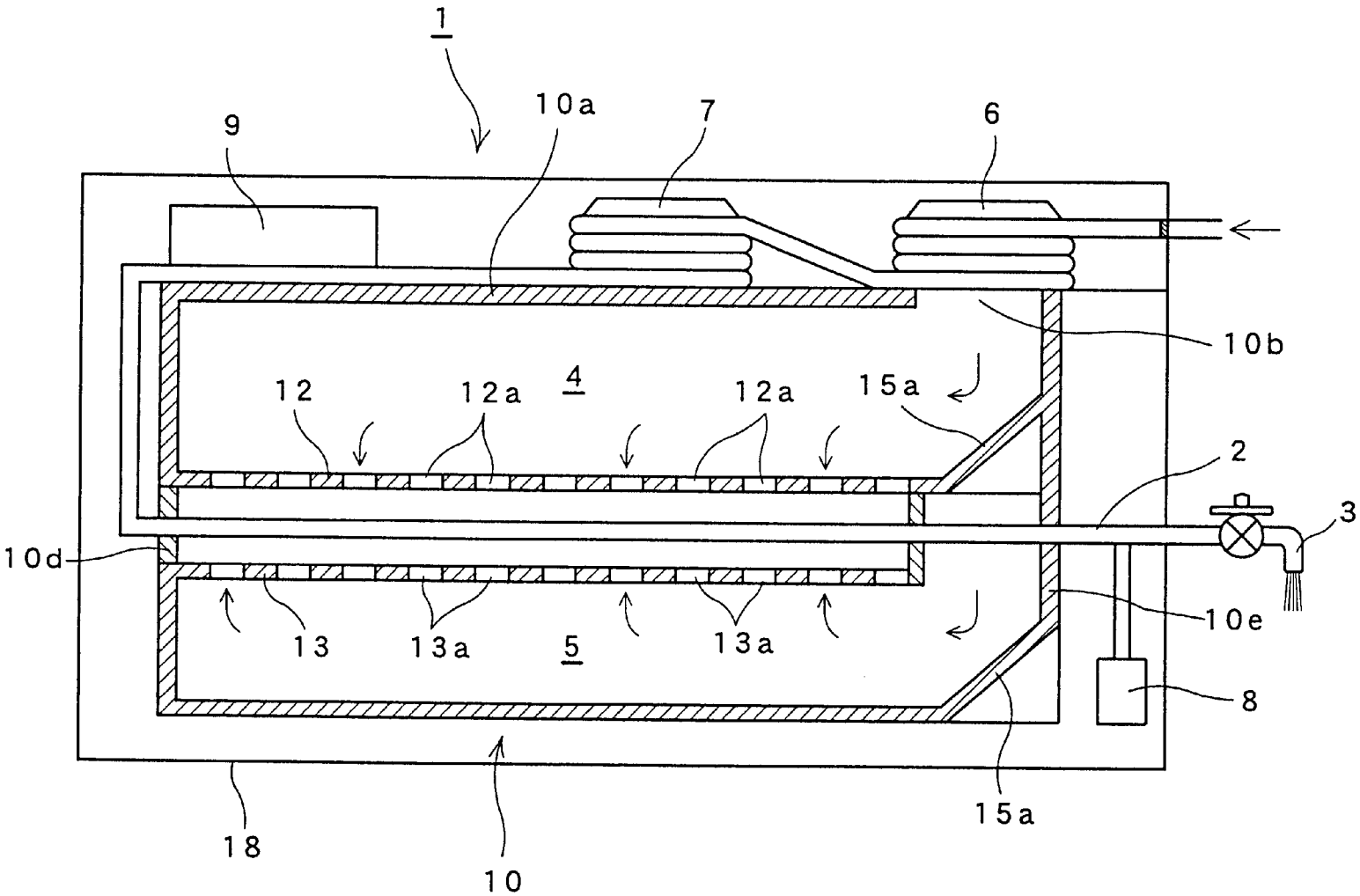
FIG. 1 is a schematic illustration of an instantaneous boiler which is one of the examples of the continuous flow type heating apparatus of the present invention.

FIG. 1 is a schematic illustration showing an instantaneous boiler as an example of the continuous flow type heating apparatus of the present invention. The instantaneous boiler 1 comprises: a water supply pipe connected to a water supply tap like tap water (not shown); a first and a second microwave irradiation part 4, 5 configured facing to each other with a center which is a water supply pipe 2 in order to heat up the water flowing in the water pipe 2; a microwave oscillator 6 to oscillate microwave; a high voltage transformer 7 which controls the output from the microwave oscillator 6; and a controller 9 which is linked to a temperature detector switch 8 located near a tap 3 of the water supply pipe 2.

Figure 2:
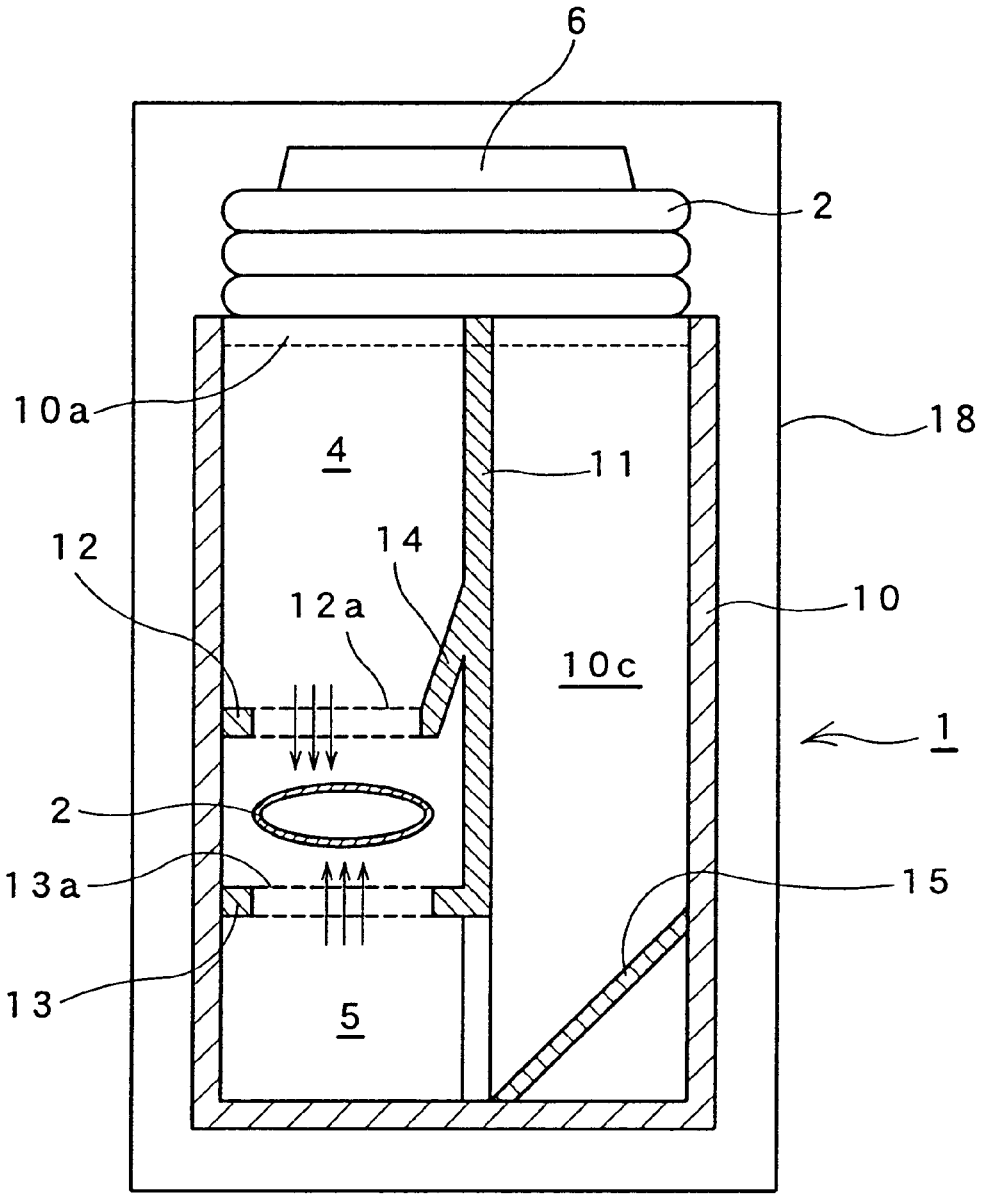
FIG. 2 is a cross-section of major parts of the instantaneous boiler as shown in FIG. 1.
Figure 3:
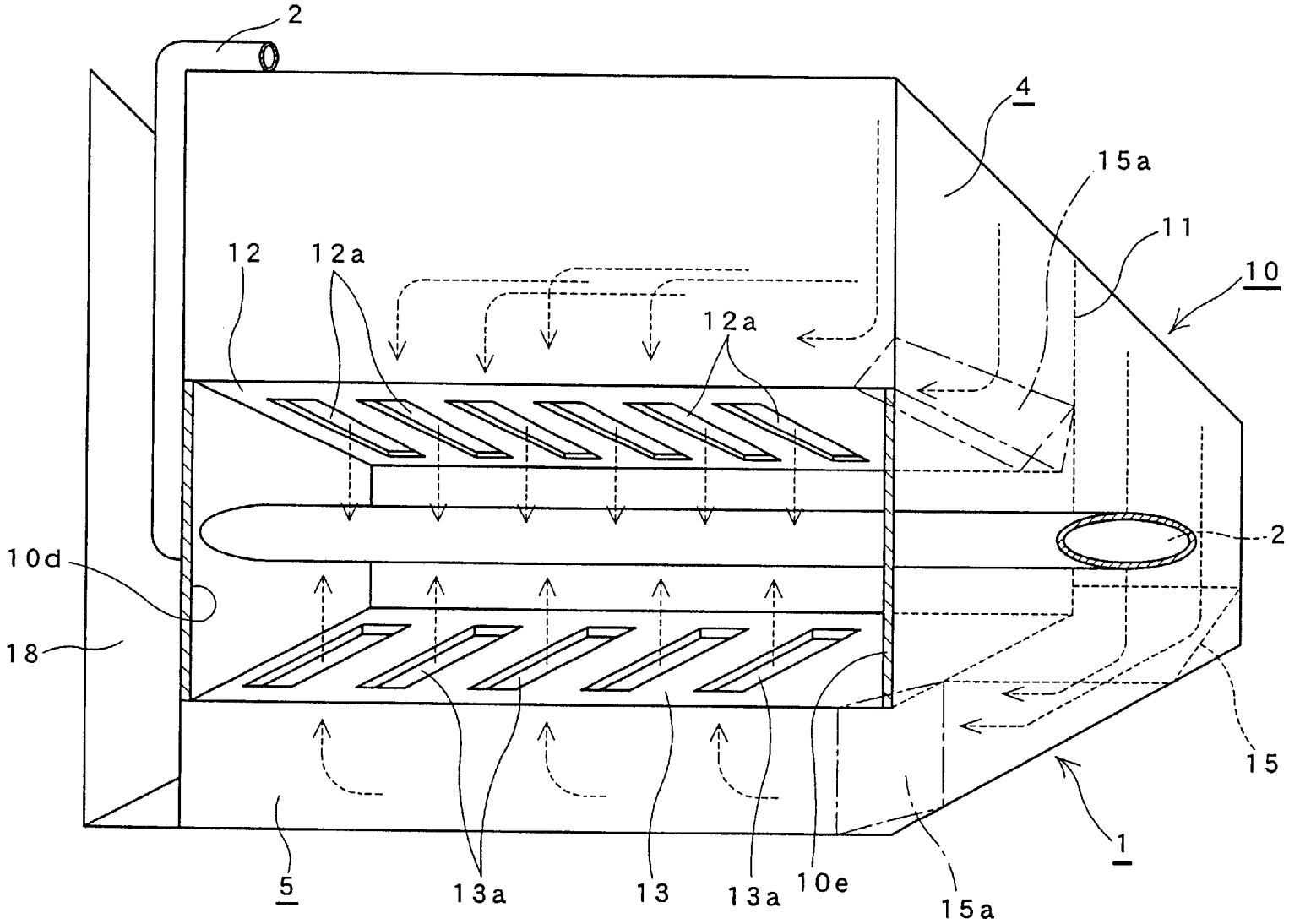
FIG. 3 is an illustration viewed at an oblique angle of major parts of the instantaneous boiler as shown in FIG. 1.

The first and the second irradiation part 4, 5 to irradiate microwave, have open part which becomes the microwave emitting port 10*b* with a desired width on one of the shorter edge sides on an upper surface 10*a* of the horizontally prolonged rectangular empty box 10 made of metallic material such as aluminum or stainless steel, as clearly shown in FIG. 2 and FIG. 3. The empty box 10 is vertically divided into two except for the upper and the lower part where the emitting port 10*b* is located. One of the divided space is further divided into three with two of an upper and a lower partition 12, 13. The upper space sectioned by the partition 12 is the first irradiation part 4. The lower space sectioned by the partition 13 is the second irradiation part 5. In the space formed between the partitions 12, 13, the water supply pipe 2 is configured such that it penetrates from one side of the shorter edge side 10*d* through to another side 10*e*. The second irradiation part 5 is connected to the other space 10*c* in the empty box 10 sectioned by the partition 11. Slits 12*a* are formed at a desired interval on the partition 12 forming the first irradiation part 4, while similar slits 13*a* are formed at a desired interval on the partition 13 forming the second irradiation part 5. The microwave irradiated from the microwave oscillator 6 is irradiated through the slits 12*a*, 13*a* to said water supply pipe 2.

The water supply pipe set in the space formed between the partitions 12, 13, is located such that its center comes almost in the middle between the partitions 12 and 13, as clearly shown in FIG. 2. The upper half and the lower half of the water supply pipe 2 are heated by 180 degree respectively, by the microwave irradiated from the first and the second irradiation part 4, 5.

The distance (interval) between the first irradiation part 4 and the second irradiation part 5 is preferably as short as possible. The shorter the distance becomes, the more efficiently the microwave is irradiated to the water supply pipe 2 to heat up the water flowing in the water supply pipe 2.

In the microwave oscillator 6, its irradiation port is set on the empty box 10 such that the port comes to the open part 10*b* formed on the upper surface 10*a* of the empty box 10. A part of the microwave emitted from the microwave oscillator 6 reaches to the first irradiation part 4 via the partition 11, and irradiates the water supply pipe 2 from the slits 12*a*, formed on the bottom of the partition 12. The other part reaches to the second irradiation part 5 via the space 10*c*, and irradiates the water supply pipe 2 from the slits 13*a*formed on the upper partition.

In the first irradiation part 4, the microwave from the microwave oscillator 6 is irradiated downward. If the partition 11 and the partition 12 meet orthogonally, the junction corner part of the two partitions becomes narrow path. This makes the effective irradiation of the microwave from the slit 12*a* to the water supply pipe 2 rather difficult. So, a guide 14 is formed at the junction part of the partition 11 and the partition 12 in order to gather microwave inward. Then, the microwave oscillated from the microwave oscillator 6 is forced to be driven to the slit 12*a* side by the guide 14, and the microwave can be effectively irradiated towards the water supply pipe 2.

Similarly, since the installation of a guide board 15 at the bottom of the space 10*c* by 45 degree enables an effective transmission of the microwave to the second irradiation part 5, the guide board 15*a* is preferably installed at a necessary part in the empty box 10 as shown in FIG. 3.

The guide 14 may have a guide board located at the bottom (virtually the partition 12) on the partition 11 side of the first irradiation part 4.

Further, in order to raise the irradiation efficiency of the microwave to the water supply pipe 2, empty blocks 16, 17 are set in the first irradiation part 4 and the second irradiation part 5, respectively. Since the blocks 16, 17 form channel paths, strong electric field is generated at the slits 12*a*, 13*a*, the irradiation efficiency of the microwave can be 50 to 100 times stronger than without the blocks 16, 17. The water having gone through the strong electric field has smaller water molecule clusters. This generates better interfacial activation effect such as removal of chlorine contained in the water, elimination of miscellaneous germs in the water, change in the water quality, prevention of the adhesion of scale (scum) to the sink, and dissolution of the adhered scale to be flushed out. So, the water suitable for drinking and a shower can be easily obtained without using commercial water filters.

Furthermore, installation of a reflective board in said first irradiation part 4 and second irradiation part 5, or making the empty box 10 itself with microwave-reflective materials like aluminum, causes the microwaves reflected from the reflective board to cross and collide at the center, generating a phenomenon similar to the effect of run-away heating which effectively raises the temperature at the central part of the water supply pipe 2.

The shape of the water supply pipe 2 set in the empty box 10 is not particularly limited as long as the pipe is of the type generally used for this kind of application. The materials with small loss coefficiency (specific dielectric constant, dielectrics loss angle) such as Teflon, polyethylene, and polypropylene are used for the pipe.

Larger flow amount inevitably requires larger diameter of the water supply pipe 2. The microwave irradiated to water osmoses to the water, becomes absorbed and converted to heat and attenuates. As the microwave goes further in the water, the microwave becomes weaker to have insignificant contribution to water heating.

Thus, when a pipe with large diameter is used, the water flowing near inner surface of the pipe is heated up to a relatively high temperature while the water flowing at center is subject to almost no influence of the microwave. This causes tepid water coming out of the tap.

As a result of a dedicated study, the inventors have found that configuring the diameter of the water supply pipe 2 within the range of 5 to 20 mm enables the most efficient heating of the water continuously flowing in the water supply pipe 2. So, the diameter of the used water supply pipe 2, within 5 to 20 mm is the most preferable.

In this case, rather than using the water supply pipe of its cross section circle, an ellipsoidal or a flat rectangular shape of the water supply pipe at the part irradiated with the microwave, can have larger flow amount of water flowing in the water supply pipe, and the microwave irradiated into the central part of the water supply pipe to supply hotter water.

Microwave can be effectively irradiated to the water supply pipe 2 by having the length of each slit 12*a*, 13*a* formed on the confronting faces of the first irradiation part 4 and the second irradiation part 5, within the diameter of the used water supply pipe, in the case of the ellipsoidal water supply pipe, its longer axis.

The microwave oscillator has a water-cooling type or an air-cooling type cooling mean to cool down the magnetron and the high voltage transformer which become hot with the oscillation of the microwave.

Since the air-cooling type has a heat radiator part in the housing for heat radiation, the interior of the housing is exposed to the noise, and the housing sucks dust which adheres on the microwave oscillator and the others to possibly give them bad influence, and electric wave leaks outside from the radiator to possibly cause unexpected influence on human body. So, the water-cooling type is preferably employed.

In the present invention, on using the water-cooling type microwave oscillator 6, as shown in FIG. 1, a part of the water supply pipe 2 is wound around the microwave oscillator 6 and the high voltage transformer 7. The water flowing in the water supply pipe 2 is temporarily pre-heated by the thermal energy emitted from the microwave oscillator 6 and the high voltage transformer 7, in order to raise the temperature of the water input. This reduces the consumed power and improves the energy efficiency.

At the same time, having the microwave oscillator 6 to be the water-cooling type, makes the housing 18 made of the shielding material containing the main body of the apparatus, completely closed type. This perfectly prevents the microwave leakage and does not require a cooling fan to cause zero noise.

In the air-cooling type, at least two open parts which are an air-in-take and air extraction port, are set in the housing. Hot air at about 30 to 80° C. is extracted outside via the air-extraction port. This limits the installation location and makes the degree of freedom of the installation quite low.

Some situation may cause a temporary halt of the apparatus by an abnormal heating. The water-cooling type clears all of such problems. The completely closed type prevents the dust coming in the housing. The electricity leakage caused by the dust is not likely to occur.

Since the temperature detector switch 8 located near the tap 3 of the water supply pipe 2, automatically detects the temperature of the hot water draining from the tap 3 and send the information to the controller 9, the hot water at a desired temperature at a constant flow amount can be obtained by automatically changing the output from the high voltage transformer 7 with a desired temperature setting by the controller 9.

The preferred examples of the present invention are explained below.

EXAMPLE 1

In an instantaneous boiler shown in FIG. 2, a power source of 100 V made by Mitsubishi Electric Corp., a microwave oscillator 6 with its maximum microwave output 500 W and consumed power 950 W and a high voltage transformer 7 were made for water cooling type. A circular pipe with a diameter of 8 mm was used for a water supply pipe 2. While water at a temperature of about 10° C. right out of the tap was supplied to the water supply pipe 2 at the flow amount of 4 liter/min, microwave of 2450 MHz was irradiated from both the upper and lower sides of the water supply pipe 2 via respective slits 12*a*, 13*a* of the first irradiation part 4 and the second irradiation part 5. Hot water at a temperature of 55° C. was obtained at tap 3.

Further, when the shape of the pipe is changed from circular to ellipsoidal shape having an equal cross-sectional area and a diameter of 4 mm (½), the heating efficiency to the water increased and the increase by about 13% was confirmed. In this way, the hot water at a temperature of 62° C. was obtained at the tap 3.

In the empty box shown in FIG. 2, the length of the water supply pipe subject to the microwave irradiation is 500 mm.

EXAMPLE 2

Figure 4:
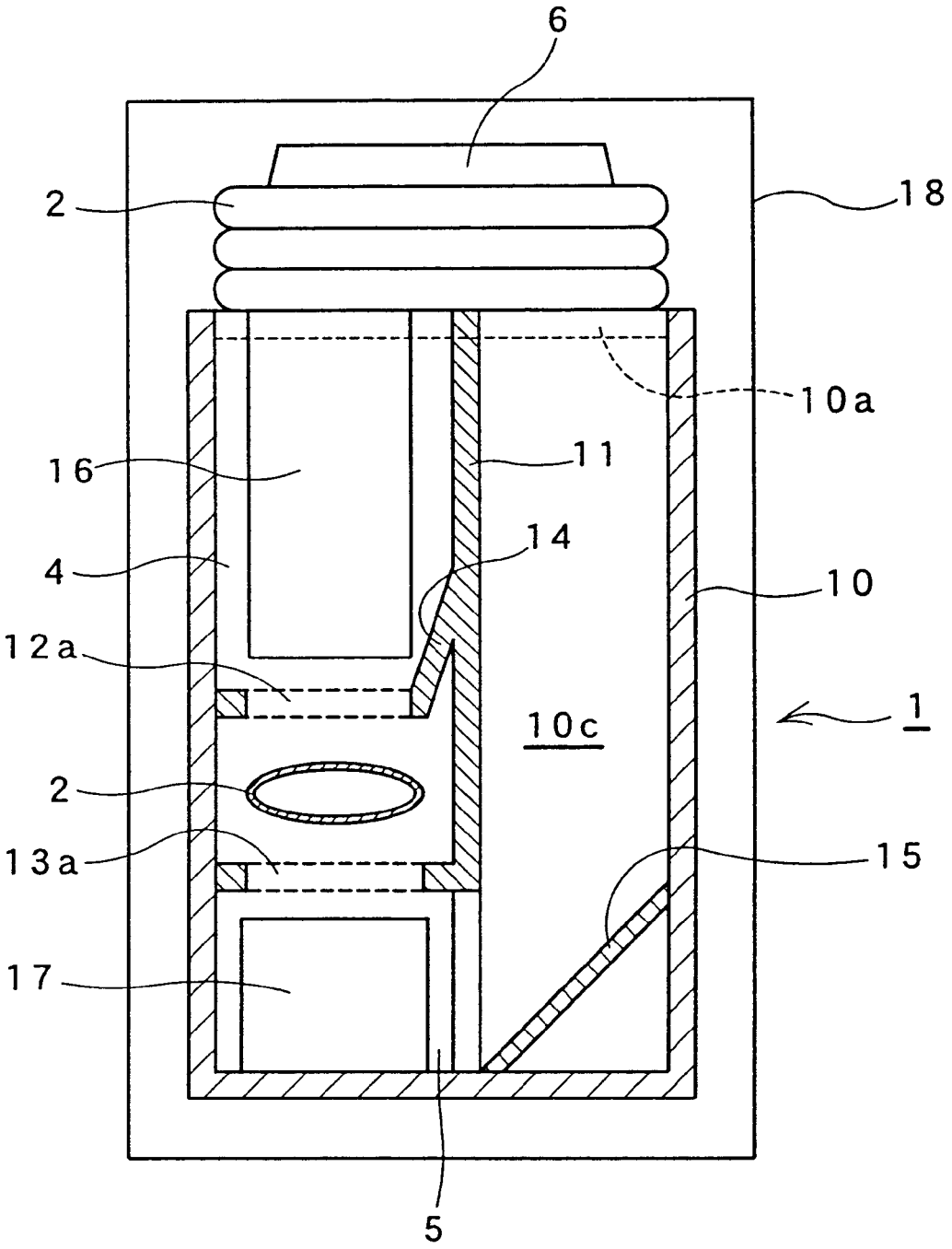
FIG. 4 is a cross-section of major parts of an alternative example of the instantaneous boiler as shown in FIG. 1.

In the instantaneous boiler in FIG. 4, a single phase power source of 200 V made by Hitachi Ltd., a microwave oscillator 6 with its maximum microwave output 1500 W and a high voltage transformer 7 were made for water cooling type. A circular pipe with a diameter of 20 mm was used for a water supply pipe 2. While water at a temperature of about 10° C. right out of the tap was supplied to the water supply pipe 2 at the flow amount of 12 liter/min, microwave of 2450 MHz was irradiated from both the upper and lower sides of the water supply pipe 2 via respective slits 12*a*, 13*a* of the first irradiation part 4 and the second irradiation part 5. Hot water at a temperature of 80° C. was obtained at the tap 3.

Further, when the shape of the pipe is changed from circular to ellipsoidal shape having an equal cross-sectional area and a diameter of 10 mm (½), the heating efficiency to the water increased and the increase by about 15% was confirmed.

In this way, the hot water at a temperature of 92° C. was obtained at the tap 3.

In the empty box shown in FIG. 2, the length of the water supply pipe subject to the microwave irradiation is 500 mm.

All the explanations in the above examples was made with respect to an instantaneous boiler. The continuous flow type heating apparatus of the present invention may be designed to be small, have a generator which can be used outdoor as a power source in order to operate the high voltage transformer and the microwave oscillator, be supplied with water from the river or lake to one end of the water supply pipe by any convenient means, and have the tap of the water supply pipe converted to a shower part to make an easy shower for outdoor use.

The water supply pipe can also be used as a heating apparatus for obtaining industrial hot water by changing the power source. So, the applications of the present invention are not limited to the instantaneous boiler.

The continuous flow type heating apparatus of the present invention comprises a water supply pipe in which fluid continuously flows, and a set of irradiation parts configured facing to each other sandwiching the water supply pipe which irradiates microwave to heat up the fluid through the water supply pipe by half portions by the induction heating.

The apparatus can efficiently heat up the flowing water, have the length of the water supply pipe as short as possible, and have no generation of noises during operation, kill the germs contained in the flowing water, to become the best instantaneous boiler obtained.

What is claimed is:

1. A continuous flow type heating apparatus which is characterized in that:

microwaves from a microwave oscillator are irradiated towards microwave irradiation parts, said microwave irradiation parts are configured facing each other with a water supply pipe, which has an ellipsoidal or flat rectangular shape, and has a diameter centered therebetween; and microwaves irradiated from each of said irradiation parts heat up fluid flowing in said water supply pipe.

2. A continuous flow type heating apparatus which is characterized in that:

microwaves from a microwave oscillator are irradiated towards a pair of microwave irradiation parts, said pair of microwave irradiation parts extending along a water supply pipe disposed at a central location between said irradiation parts, said pair of irradiation parts having a plurality of slits formed at predetermined intervals extending alongside said water supply pipe, said slits are configured to face each other; and fluid flowing in said water supply pipe is heated by microwaves irradiated from said slits.

3. A continuous flow type heating apparatus which is characterized in that:

an open part with a predetermined width is formed on a top face of one side of a horizontally prolonged box made of metallic material, to be an emitting port of microwave; and said box is divided by a vertical partition into two portions extending along the horizontally prolonged direction, wherein said vertical partition does not divide said emitting port of microwaves;

a space on one side of the vertical partition is horizontally divided into three portions extending along the horizontally prolonged direction by upper and lower partitions having slits at predetermined intervals, wherein said slits are arranged orthogonal to the horizontally prolonged direction;

a space formed on the upper partition becomes a first irradiation part;

a space formed under the lower partition is connected to a space on another side of the vertical partition and becomes a second irradiation part; and a water supply pipe is disposed at a central part of a space formed between the upper and lower partitions;

microwaves from a microwave oscillator set on said box are irradiated from said emitting port into the box; and microwaves from slits of said each irradiation part are irradiated to upper and lower parts of the water supply pipe, respectively.

4. A continuous flow type heating apparatus described in any one of claims 1 to 3 which is characterized in that said water supply pipe has a diameter within 5 to 20 mm.

5. A continuous flow type heating apparatus described in claim 2 or 3 which is characterized in that each of said slits has a length within a diameter of said water supply pipe.

6. A continuous flow type heating apparatus described in claim 3 which is characterized in that each irradiation part formed in said box comprising blocks forming a channel path in said box, and a strong electric field is generated at said each slit.

7. A continuous flow type heating apparatus described in claim 3 which is characterized in that said microwave oscillator is water cooling type.

8. A continuous flow type heating apparatus described in claim 3 which is characterized in that said microwave oscillator is water cooling type, and a part of water supply pipe is wound around said microwave oscillator in order to pre-heat fluid to be heated.

9. A continuous flow type heating apparatus described in claim 3 which is characterized in that said box has a guide part to gather microwaves inward at a junction part of the vertical partition and horizontal partition forming first irradiation part when forming first irradiation part.

10. A continuous flow type heating apparatus described in claim 3 or 9 which is characterized in that said box has a guide board, other than said guide part, in order to converge microwaves towards the slits on each partition set horizontal.

11. A continuous flow type heating apparatus described in claim 10 which is characterized in that said guide board is set in said box at an angle of 45 degrees.

* * * * *